US007244152B1

(12) United States Patent
Uppgard

(10) Patent No.: US 7,244,152 B1
(45) Date of Patent: Jul. 17, 2007

(54) SUPPORT SYSTEM FOR AN OUTBOARD MOTOR

(75) Inventor: Darin C. Uppgard, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/350,517

(22) Filed: Feb. 9, 2006

(51) Int. Cl.
*B63H 5/20* (2006.01)

(52) U.S. Cl. ..... 440/53; 440/61 R

(58) Field of Classification Search ..... None
See application file for complete search history.

(56) References Cited

U.S. PATENT DOCUMENTS 4,391,592 A * 7/1983 Hundertmark ..... 440/61 R
4,406,634 A * 9/1983 Blanchard ..... 440/61 R
4,545,770 A * 10/1985 Ferguson ..... 440/61 R
4,878,865 A * 11/1989 Makihara et al. ..... 440/61 R
5,219,306 A * 6/1993 Takahashi ..... 440/52
6,146,220 A 11/2000 Alby et al. ..... 440/53
6,183,321 B1 2/2001 Alby et al. ..... 440/61
6,276,977 B1 8/2001 Treinen et al. ..... 440/61
6,402,577 B1 6/2002 Treinen et al. ..... 440/61
6,419,534 B1 7/2002 Helsel et al. ..... 440/52
6,682,374 B2 * 1/2004 Kokubo ..... 440/53
6,821,168 B1 11/2004 Fisher et al. ..... 440/61 R

* cited by examiner

*Primary Examiner*—Lars A. Olson
(74) *Attorney, Agent, or Firm*—William D. Lanyi

(57) ABSTRACT

An adapter system is provided as a transition structure which allows a relatively conventional outboard motor to be mounted to a pedestal which provides a generally stationary vertical steering axis. An intermediate member is connectable to a transom mount structure having a connector adapted for mounts with central axes generally perpendicular to a plane of symmetry of the marine vessel. Many types of outboard motors have mounts that are generally perpendicular to this configuration. The intermediate member provides a suitable transition structure which accommodates both of these configurations and allows the conventionally mounted outboard motor to be supported, steered, and tilted by a transom mount structure having the stationary vertical steering axis and pedestal-type configuration.

15 Claims, 7 Drawing Sheets

SUPPORT SYSTEM FOR AN OUTBOARD MOTOR

BACKGROUND OF THE INVENTION

1. Field of the Invention

The present invention relates generally to a support system for an outboard motor and, more particularly, to a system and structure that allows a conventionally mounted outboard motor to be supported and manipulated by a transom mount structure of the pedestal-type.

2. Description of the Related Art

Those skilled in the art of marine propulsion systems are aware of several techniques for supporting an outboard motor on a transom of a marine vessel.

U.S. Pat. No. 6,146,220, which issued to Alby et al. on Nov. 14, 2000, discloses a pedestal mount for an outboard motor. An outboard motor is mounted to a transom of a boat with a pedestal that is attached either directly to the transom or to an intermediate plate that is, in turn, attached to the transom. A motor support platform is attached to the outboard motor, and a steering mechanism is attached to both the pedestal and the motor support platform. The tilting mechanism is attached to the motor support platform and to the outboard motor. The outboard motor is rotatable about a tilting axis relative to both the pedestal and the motor support platform. The tilting mechanism is rotatable relative to the pedestal and about a steering axis. The steering axis is generally vertical and stationary relative to the pedestal and is unaffected by the tilting of the outboard motor. The tilting mechanism is rotatable relative to the pedestal and about the steering axis with the outboard motor.

U.S. Pat. No. 6,183,321, which issued to Alby et al. on Feb. 6, 2001, discloses an outboard motor with a hydraulic pump and an electric motor located within a steering mechanism. The outboard motor comprises a pedestal that is attached to a transom of a boat, a motor support platform that is attached to the outboard motor, and a steering mechanism that is attached to both the pedestal and the motor support platform. It comprises a hydraulic tilting mechanism that is attached to the motor support platform and to the outboard motor. The outboard motor is rotatable about a tilt axis relative to both the pedestal and the motor support platform.

U.S. Pat. No. 6,276,977, which issued to Treinen et al. on Aug. 21, 2001, discloses an integrated hydraulic steering actuator. The actuator is provided for an outboard motor system in which the cylinder and piston of the actuator are disposed within a cylindrical cavity inside a cylindrical portion of a swivel bracket. The piston within the cylinder of the actuator is attached to at least one rod that extends through clearance holes of a clamp bracket and is connectable to a steering arm of the outboard motor.

U.S. Pat. No. 6,402,577, which issued to Treinen et al. on Jun. 11, 2002, discloses an integrated hydraulic steering system for a marine propulsion unit. The system is provided in which a steering actuator is an integral portion of the support structure of a marine propulsion system. A steering arm is contained completely within the support structure of the marine propulsion system and disposed about its steering axis. An extension of the steering arm extends into a sliding joint which has a linear component and a rotational component which allow the extension of the steering arm to move relative to a movable second portion of the steering actuator. The movable second portion of the steering actuator moves linearly within a cylinder cavity formed in a first portion of the steering actuator.

U.S. Pat. No. 6,419,534, which issued to Helsel et al. on Jul. 16, 2002, discloses a structural support system for an outboard motor. The system is provided for an outboard motor which uses four connectors attached to a support structure and to an engine system for isolating vibration from being transmitted to the marine vessel to which the outboard is attached. Each connector comprises an elastomeric portion for the purpose of isolating the vibration. Furthermore, the four connectors are disposed in a common plane which is generally perpendicular to a central axis of a driveshaft of the outboard motor. Although precise perpendicularity with the driveshaft axis is not required, it has been determined that if the plane extending through the connectors is within 45 degrees of perpendicularity with the driveshaft axis, improved vibration isolation can be achieved. A support structure, or support saddle, completely surrounds the engine system in the plane of the connectors. All of the support of the outboard motor is provided by the connectors within the plane, with no additional support provided at a lower position on the outboard motor driveshaft housing.

U.S. Pat. No. 6,821,168, which issued to Fisher et al. on Nov. 23, 2004, discloses a power steering system for a marine vessel. An outboard motor is provided with an internally contained cylinder and movable piston. The piston is caused to move by changes in differential pressure between first and second cavities within the cylinder. By adding a hydraulic pump and steering valve, the hydraulic steering system described in U.S. Pat. No. 6,402,577 is converted to a power hydraulic steering system by adding a hydraulic pump and a steering valve to a manual hydraulic steering system.

The patents described above are hereby expressly incorporated by reference in the description of the present invention.

Many types of outboard motors use mounts which are generally concentric about axes which are generally parallel to a plane of symmetry of a marine vessel. It would therefore be significantly beneficial if a support system could be provided which allowed those types of outboard motors to be adapted for use in conjunction with a pedestal-type transom bracket having a generally stationary vertical steering axis.

SUMMARY OF THE INVENTION

A support system for an outboard motor made in accordance with a preferred embodiment of the present invention comprises a transom mount structure which is attachable to a transom of a marine vessel. The marine vessel has a generally vertical plane of symmetry which divides the marine vessel into port and starboard portions. The transom of the marine vessel is generally perpendicular to the plane of symmetry of the marine vessel. The transom mount structure is configured to define a generally vertical steering axis which is generally parallel to the plane of symmetry and fixed in relation to the transom of the marine vessel. The transom mount structure is configured to define a generally horizontal tilt axis which is generally perpendicular to the plane of symmetry and fixed in relation to the transom of the marine vessel. The support system in a preferred embodiment of the present invention further comprises an outboard motor having a plurality of mounts attached thereto. Each of the plurality of mounts has a central axis which is generally parallel to the plane of symmetry. In addition, a preferred embodiment of the present invention further comprises an intermediate member which is attachable to the transom mount structure for rotation about the tilt axis relative to the transom and for rotation about the steering axis relative to the transom mount structure. The intermediate member is attachable to the plurality of mounts of the outboard motor.

In a particularly preferred embodiment of the present invention, it further comprises one or more hydraulic cylinders attached between the transom mount structure and the intermediate member. The hydraulic cylinder is configured to exert a force which causes the outboard motor to rotate about the tilt axis. It can further comprise first and second protrusions extending from the intermediate member in a direction toward the transom mount structure on port and starboard sides, respectively, of a portion of the transom mount structure when the intermediate member is rotated about the tilt axis to move a driveshaft housing of the outboard motor to a position within a preselected distance of the transom In a particularly preferred embodiment of the present invention, it further comprises a plurality of rod-shaped fasteners, each of the plurality of rod-shaped fasteners extending through a preselected hole through the intermediate member and into an associated one of the plurality of mounts. A first one of the plurality of mounts is attached to a driveshaft housing of the outboard motor and a second one of the plurality of mounts is attached to an adapter plate of the outboard motor. The outboard motor and the intermediate member are attached to each other for synchronous rotation about the tilt axis.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
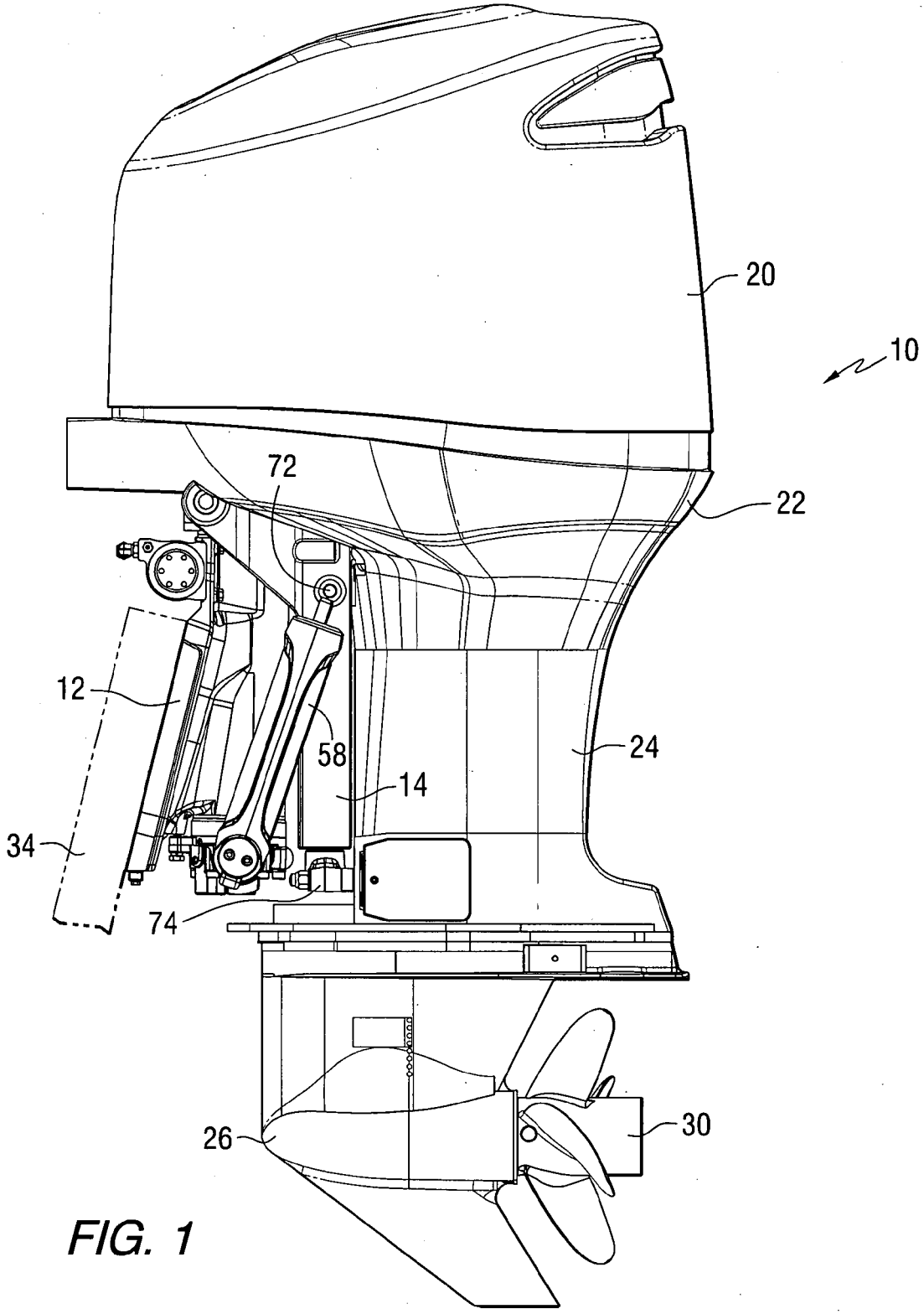
FIG. 1 is a side view of an outboard motor and support system made in accordance to a preferred embodiment of the present invention.

Throughout the description of the preferred embodiment of the present invention, like components will be identified by like reference numerals.

FIG. 1 shows an outboard motor 10, a transom mount structure 12, and an intermediate member 14. As is generally well known to those skilled in the art, the outboard motor 10 has a cowl structure 20 used to provide a cover for an internal combustion engine. A lower cowl structure 22 provides a cover for a portion of the outboard motor 10 in the general vicinity of an adapter plate (not shown in FIG. 1). A driveshaft housing 24 is supported below the lower cowl structure 22 and a gear case 26 is supported below the driveshaft housing 24. In a manner generally known to those skilled in the art, a propeller shaft is supported by the gear case 26 for rotation about a generally horizontal axis and a propeller 30 is attached to the propeller shaft.

With continued reference to FIG. 1, the transom mount structure 12 is configured to be attached to a transom 34 of a marine vessel. Although not shown in FIG. 1, those skilled in the art of marine propulsion systems are familiar with the relative positions of a transom 34, the port and starboard portions of the marine vessel, and a generally vertical plane of symmetry that divides the marine vessel into port and starboard portions. This generally vertical plane of symmetry extends along the keel of the marine vessel and is generally perpendicular to the plane of the transom 34.

In a particularly preferred embodiment of the present invention, the transom mount structure 12 comprises the components illustrated in U.S. Pat. Nos. 6,146,220 and 6,183,321. In addition, the hydraulic steering mechanism of the transom mount structure 12 can comprise the components described in U.S. Pat. No. 6,402,577. As described in detail in the United States patents referred to immediately above, the transom mount structure of this type is particularly intended for use with an outboard motor having a mount structure similar to that described in U.S. Pat. No. 6,419,534. As described in detail in U.S. Pat. No. 6,419,534, the mounts in an outboard motor of this type are configured to have their central axes aligned in a parallel relationship with the plane of the transom 34. In other words, these central axes of the mounts extend in directions from port to starboard and attach the adapter plate of the outboard motor to the transom mount structure 12 with mounts which have central axes parallel to the plane of the transom 12.

Since many types of outboard motors have mounts configured to have central axes which are generally parallel to the plane of symmetry of the marine vessel, which is perpendicular to the plane of the transom 34, those types of outboard motors are not intended for use with transom mount structures such as the one identified by reference numeral 12 in FIG. 1. Therefore, one of the primary purposes of the present invention is to allow a transom mount structure 12 of the type described in U.S. Pat. Nos. 6,146,220 and 6,183,321 to be used in conjunction with an outboard motor that was not originally designed for use with this type of transom mount structure.

Figure 2:
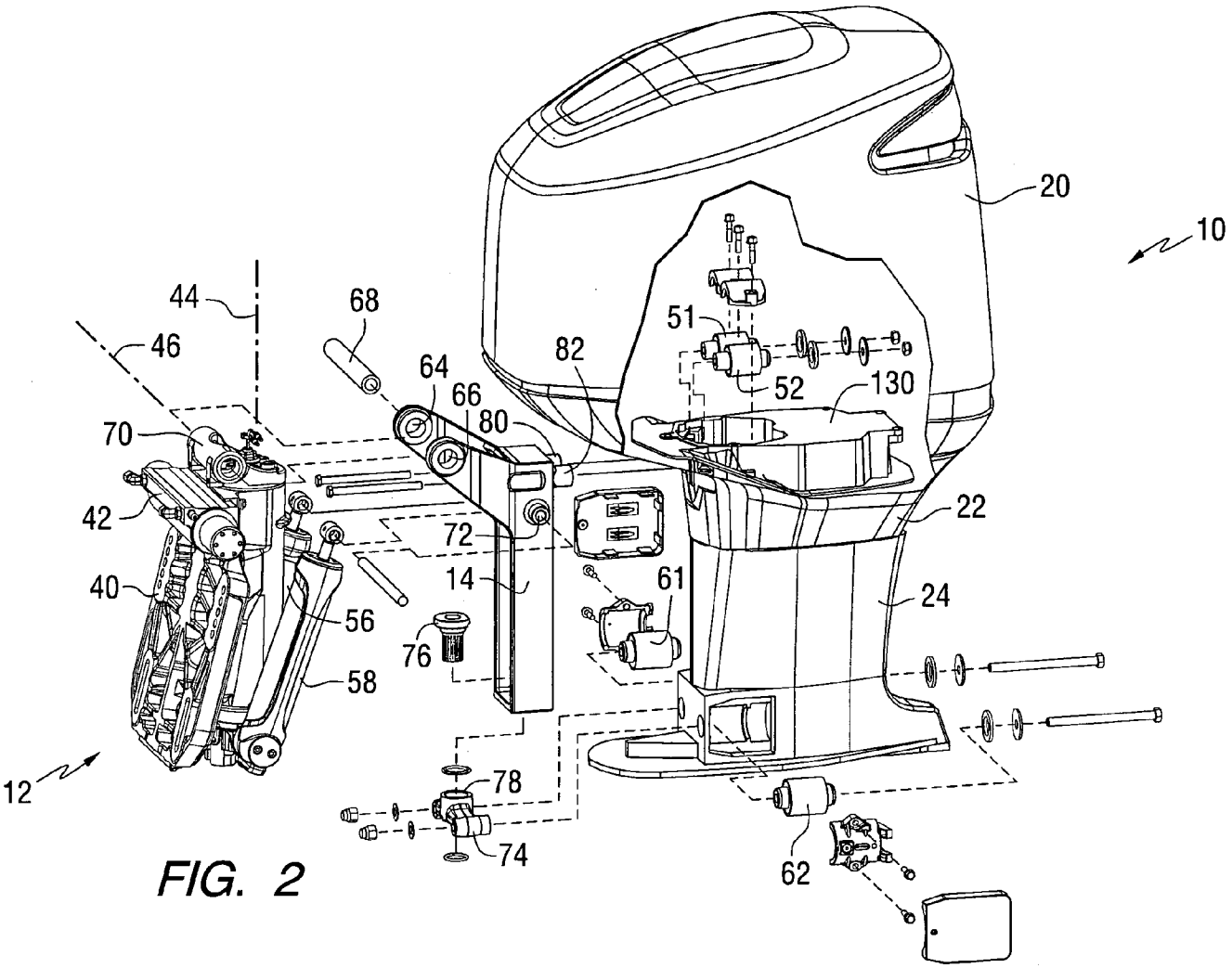
FIG. 2 is an exploded isometric view of the present invention.

FIG. 2 is an exploded isometric view of the outboard motor support system. The transom mount structure 12 is provided with a plate 40 that is attachable to a transom 34, as described above in conjunction with FIG. 1. It is also provided with a hydraulic steering system 42 which is described in detail in U.S. Pat. Nos. 6,146,220 and 6,183,321. A steering axis is identified by dashed line 44 and a trim axis is identified by dashed line 46. The outboard motor 10 is provided with upper mounts, 51 and 52, and lower mounts, 61 and 62. The illustrated hardware associated with these mounts, and shown in FIG. 2, will not be described in detail herein and not identified by associated reference numerals. However, it can be seen in FIG. 2 that the central axes of the mounts, 51, 52, 61 and 62, are aligned in parallel relation with a generally vertical plane of symmetry of a marine vessel which, although not shown in FIG. 2, is generally perpendicular to the plane of the face 40 of the transom mount structure 12. As described above, that vertical plane of symmetry is one which divides the marine vessel into port and starboard portions. As also described above, the central keel of the marine vessel lies in that plane of symmetry. It can also be seen that the central axes of the mounts, 51, 52, 61 and 62, are generally perpendicular to a vertical plane in which the trim axis 46 is disposed.

With continued reference to FIG. 2, hydraulic cylinders, 56 and 58, are attached between the transom mount structure 12 and the outboard motor 10. These hydraulic cylinders are configured to exert a force which causes the outboard motor 10 to rotate about the tilt axis 46, or trim axis. The hydraulic cylinders, 56 and 58, are pivotally attached to the intermediate member 14 which, in turn, is attached to the outboard motor 10.

The holes, 64 and 66, of the intermediate member 14, cooperate with the rod 68, or tube, to attach the intermediate member 14 to the tilt structure 70 to allow the intermediate member 14 to rotate about the tilt axis 46 when the hydraulic cylinders, 56 and 58, exert a force on the intermediate member 14 at location 72 and a similar location (not visible in FIG. 2) on the opposite side of the intermediate member 14.

An attachment structure 74 is configured to be attached to the lower mounts, 61 and 62. It is attachable to the intermediate member 14 through the use of a splined component 76 which is configured to pass through a hole (not shown in FIG. 2) in the intermediate member 14 and also through a central opening 78 in the attachment member 74. The intermediate member 14 is also provided with an upper attachment location, comprising components 80 and 82, which are configured to be attached to the upper mounts, 51 and 52. When the attachment structure 74 is attached to the lower mounts, 61 and 62, and the upper attachment structure comprising components 80 and 82 is attached to the upper mounts, 51 and 52, the outboard motor 10 is generally rigidly attached to the intermediate member 14. This attachment also benefits from the vibration isolation characteristics of elastomeric portions of the upper and lower mounts.

With continued reference to FIGS. 1 and 2, it should be realized that the intermediate member 14 provides a transition device which allows a conventionally mounted outboard motor 10 to be adapted to a transom mount structure 12 which is otherwise intended for use with an outboard motor having mounts with central axes that are generally parallel to the tilt axis 46. Without an intermediate member 14, such as the one shown in FIGS. 1 and 2, this type of adaptation between an outboard motor 10 with a relatively standard mount structure to a transom mount structure 12 such as that illustrated in FIGS. 1 and 2 would not be possible. As described in detail in U.S. Pat. Nos. 6,146,220 and 6,183,321 the transom mount structure 12 illustrated in FIGS. 1 and 2 provides significant advantages over other types of transom brackets. Among these advantageous characteristics is the fact that the steering axis 44 is stationary relative to the transom mount structure 12 and to the transom of the marine vessel. As the outboard motor 10 is rotated about the steering axis 44, the angle of tilt of the outboard motor does not change. A transom mount structure 12, such as the one shown in FIGS. 1 and 2, is able to maintain this type of independence between the trim axis 46 and the steering axis 44.

Figure 3:
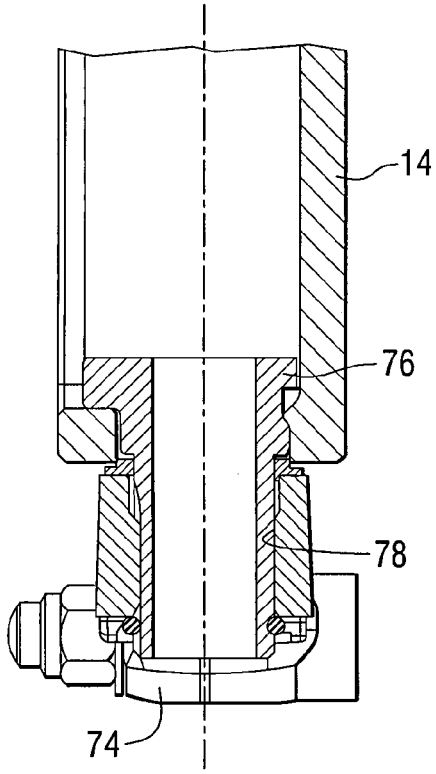
FIG. 3 is a section view of a portion of an intermediate member of the present invention.

FIG. 3 is a section view taken through the intermediate member 14 which shows the relationship between the mounting structure 74 and the splined component 76 which extends downwardly through a hole in the intermediate member 14 and into the hole 78 of the mounting structure 74.

Figure 4:
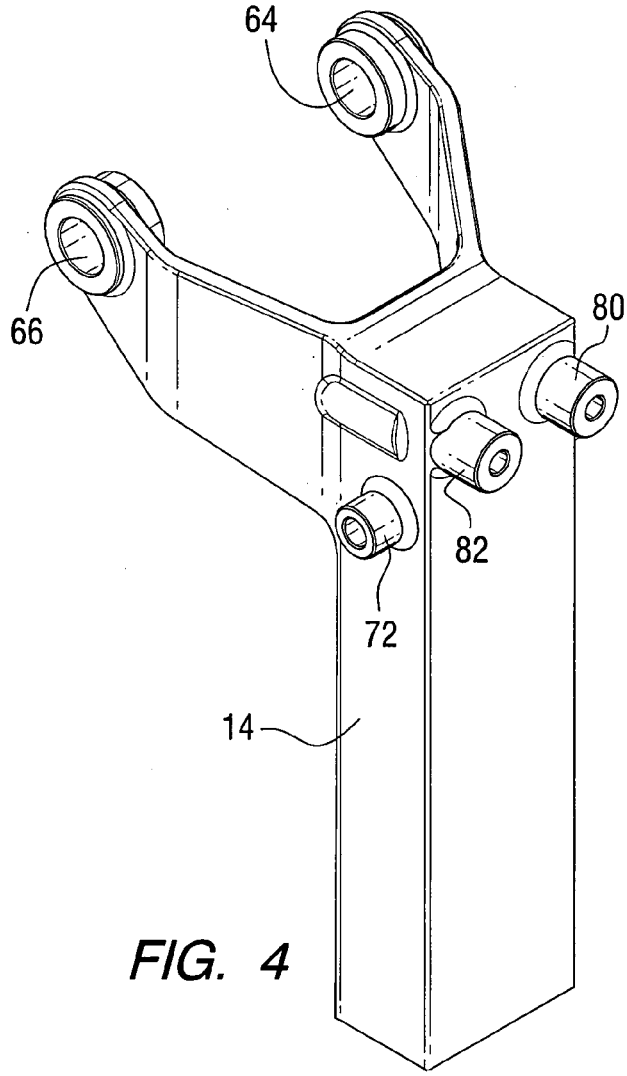
FIG. 4 is an isometric view of the intermediate member of the present invention.

FIG. 4 is an isometric view of the intermediate member 14 showing the openings, 64 and 66, which are configured to receive the pin 68, or tube, for attachment to the tilt device 70 described above in conjunction with FIG. 2. In addition, FIG. 4 shows the attachment devices, 80 and 82, which are configured to be attached to the upper mounts, 51 and 52, as described above in conjunction with FIG. 2. Also shown in FIG. 4 is the attachment point 72 where the piston of the hydraulic cylinder 58, described above, is attached to the intermediate member 14.

Figure 5:
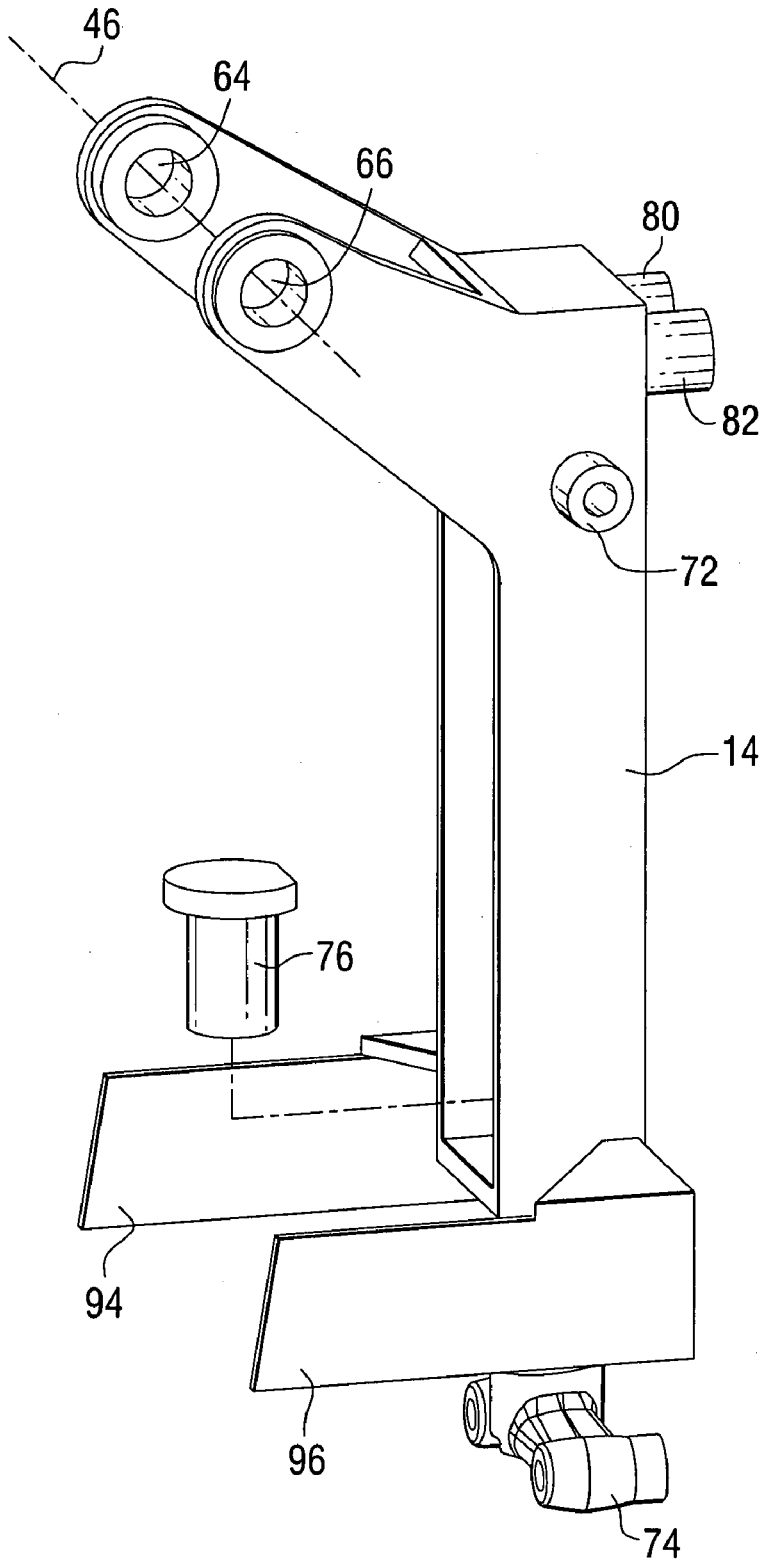
FIG. 5 is an alternative embodiment of the intermediate member of the present invention.

FIG. 5 is an isometric view of an intermediate member 14 of an alternative embodiment that is slightly modified relative to the intermediate member 14 described above in conjunction with FIGS. 1-4. In FIG. 5, first and second protrusions, 94 and 96, extend from the intermediate member 14 in a direction toward the transom mount structure 12 which is illustrated in FIG. 2. The first and second protrusions, 94 and 96, extend on the port and starboard sides of a portion of the transom mount structure 12 when the intermediate member 14 is rotated about the tilt axis 46 to move the driveshaft housing 24 of the outboard motor 10 to a position within a preselected distance of the transom 34, such as the distance illustrated in FIG. 1. The purpose of the first and second protrusions, 94 and 96, is to provide stability under certain conditions that would otherwise attempt to move the lower portion of the outboard motor 10 toward the port or starboard directions relative to the lower portions of the cylinders, 56 and 58.

Figure 6:
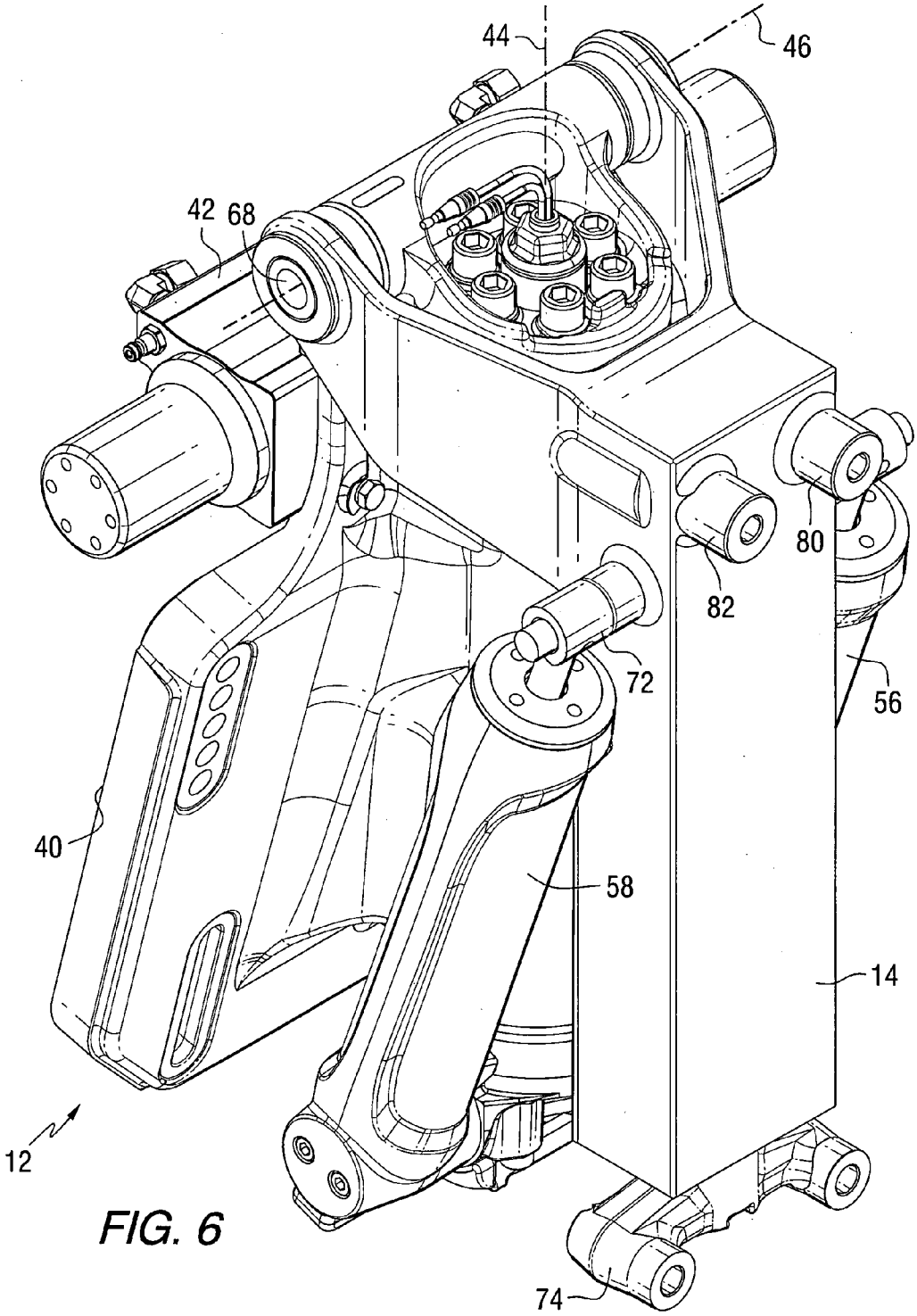
FIG. 6 shows a transom mount structure attached to an intermediate member of the present invention.

FIG. 6 is an isometric view showing the combination of the transom mount structure 12 and the intermediate member 14. As can be seen, when the cylinders, 56 and 58, are activated, the intermediate member 14 is rotatable about the tilt axis 46. FIG. 6 also shows the attachment devices, 80 and 82, where the upper mounts, 51 and 52, can be attached to the intermediate member 14. Similarly, the attachment device 74 is shown in FIG. 6 and represents the location where the lower mounts, 61 and 62, can be attached to the intermediate member 14.

Figure 7:
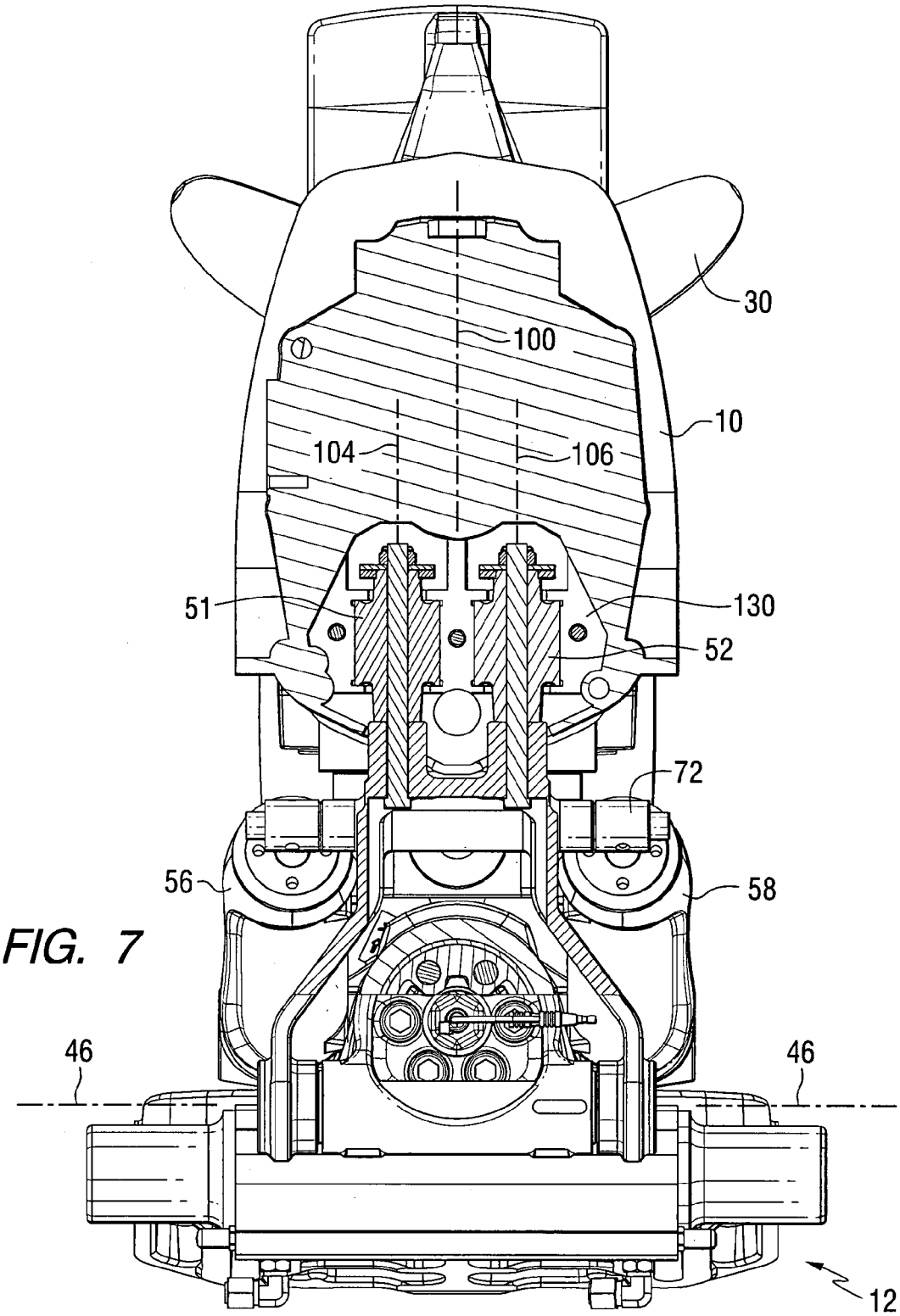
FIG. 7 is a section view of the upper mounts of an outboard motor attached to an intermediate member and a transom mounted structure of the present invention.

FIG. 7 is a section view through the upper mounts, 51 and 52. Dashed line 100 represents the position of a generally vertical plane of symmetry that divides the marine vessel into port and starboard portions. This plane of symmetry 100 is generally perpendicular to a plane of the attachment face 40 of the transom mount structure 12. The central axes, 104 and 106, of the two upper mounts, 51 and 52, are shown in FIG. 7 to be generally parallel to the plane of symmetry 100. These axes of the upper mounts, 51 and 52, are also shown to be generally perpendicular to the tilt axis 46. The two hydraulic cylinders, 56 and 58, are also shown in FIG. 7.

Figure 8:
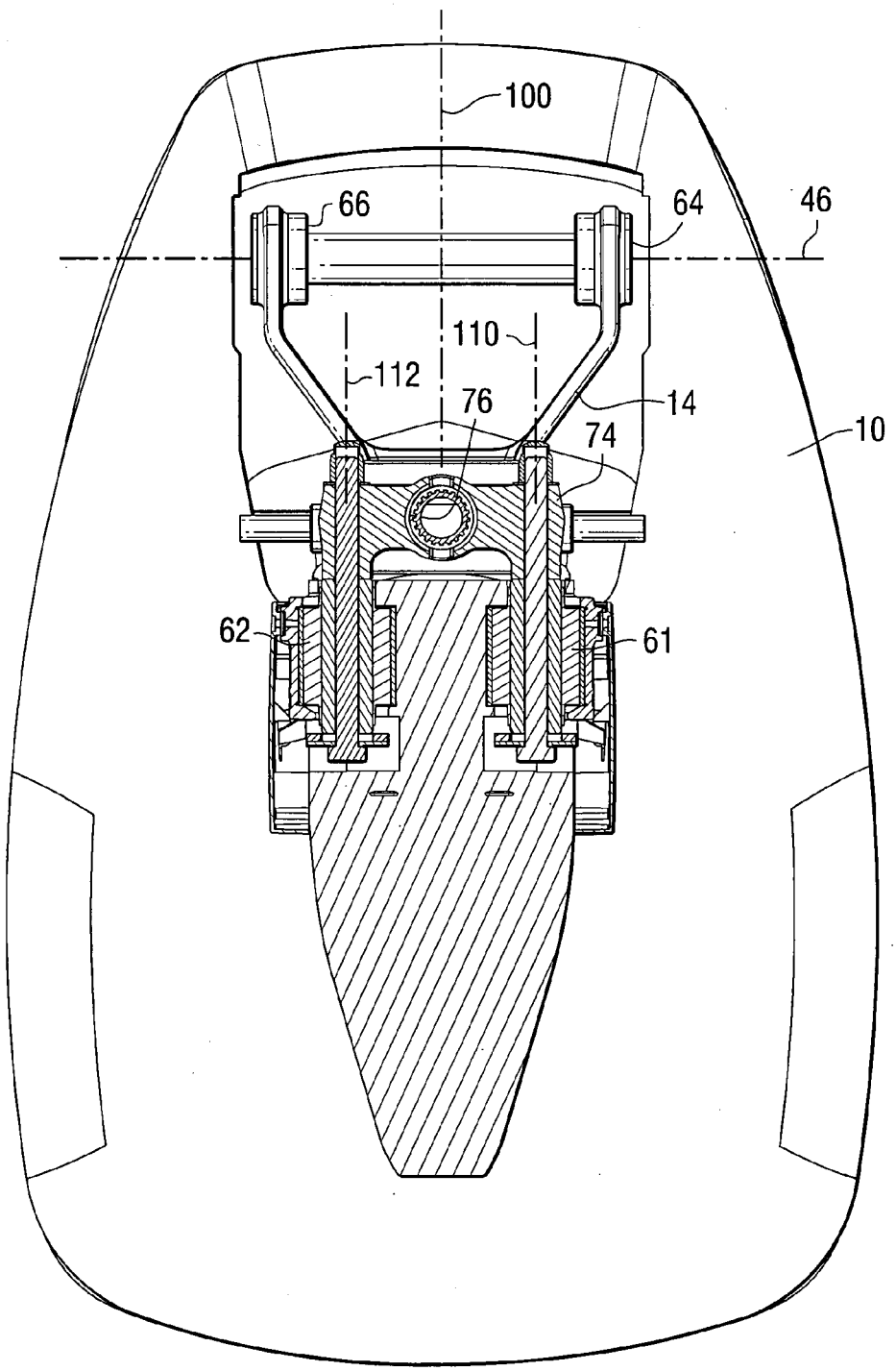
FIG. 8 is a section view of the lower mounts of an outboard motor attached to an intermediate member of the present invention.

FIG. 8 is a section view showing the outboard motor 10 and the lower mounts, 61 and 62. The central axes of the lower mounts, 110 and 112, are illustrated in FIG. 8 as being generally parallel to the plane of symmetry 100 described above. Also shown is the attachment device 74 and the splined member 76. The central axes, 110 and 112, of the lower mounts, 61 and 62, are illustrated in FIG. 8 as being generally perpendicular to the plane in which the tilt axis 46 is disposed.

With reference to FIGS. 1-8, it can been seen that a support system for an outboard motor 10, made in accordance with a particularly preferred embodiment of the present invention comprises a transom mount structure 12 which is attachable to a transom 34 of a marine vessel. The marine vessel has a generally vertical plane of symmetry 100 which divides the marine vessel into port and starboard portions. The transom 34 is generally perpendicular to the plane of symmetry 100 of the marine vessel. The transom mount structure 12 is configured to define a generally vertical steering axis 44 which is generally parallel to the plane of symmetry 100 and fixed in relation to the transom 34 of the marine vessel. The transom mount structure 12 is configured to define a generally horizontal tilt axis 46 which is generally perpendicular to the plane of symmetry and fixed in relation to the transom 34 of the marine vessel. An outboard motor 10 has a plurality of mounts, 51, 52, 61 and 62, attached thereto. Each of the plurality of mounts has a central axis, 104, 106, 110 and 112, which is generally parallel to the plane of symmetry 100. An intermediate member 14 is attachable to the transom mount structure 12 for rotation about the tilt axis 46 relative to the transom 34 and for rotation about the steering axis 44 relative to the transom 34. The intermediate member 14 is attachable to the plurality of mounts, 51, 52, 61 and 62, of the outboard motor 10. Hydraulic cylinders, 56 and 58, are attached between the transom mount structure 12 and the intermediate member 14 which is, in turn, attached to the outboard motor 10. The hydraulic cylinders are configured to exert a force which causes the outboard motor 10 to rotate about the tilt axis 46. First and second protrusions, 94 and 96, extend from the intermediate member 14 in one embodiment of the present invention in a direction toward the transom mount structure 12 on port and starboard sides of a portion of the transom mount structure 12 when the intermediate member 14 is rotated about the tilt axis 46 to move a driveshaft housing 24 of the outboard motor 10 to a position within a preselected distance of the transom 34. This rotation is in the clockwise direction with respect to FIG. 1. A plurality of rod-shaped fasteners extend through preselected holes in the intermediate member 14 and into associated mounts. At least one of the plurality of mounts, 61 and 62, is attached to a driveshaft housing 24 of the outboard motor 10 and at least another one of the plurality of mounts, 51 and 52, is attached to an adapter plate 130 of the outboard motor 10. The outboard motor 10 and the intermediate member 14 are attached to each other for synchronous rotation about the tilt axis 46.

Although the present invention has been described with particular specificity and illustrated to show a preferred embodiment, it should be understood that alternative embodiments are also within its scope.

I claim:

1. A support system for an outboard motor, comprising:

a transom mount structure which is attachable to a transom of a marine vessel, said marine vessel having a generally vertical plane of symmetry which divides said marine vessel into port and starboard portions, said transom being generally perpendicular to said plane of symmetry of said marine vessel, said transom mount structure being configured to define a generally vertical steering axis which is generally parallel to said plane of symmetry and fixed in relation to said transom of said marine vessel, said transom mount structure being configured to define a generally horizontal tilt axis which is generally perpendicular to said plane of symmetry and fixed in relation to said transom of said marine vessel;

an outboard motor having a plurality of mounts attached thereto, each of said plurality of mounts having a central axis which is generally parallel to said plane of symmetry; and an intermediate member which is attachable to said transom mount structure for rotation about said tilt axis relative to said transom and for rotation about said steering axis relative to said transom, said intermediate member being attachable to said plurality of mounts of said outboard motor.

2. The support system of claim 1, further comprising:

a hydraulic cylinder attached between said transom mount structure and said outboard motor, said hydraulic cylinder being configured to exert a force which causes said outboard motor to rotate about said tilt axis.

3. The support system of claim 1, further comprising:

first and second protrusions extending from said intermediate member in a direction toward said transom mount structure on port and starboard sides, respectively, of a portion of said transom mount structure when said intermediate member is rotated about said tilt axis to move a driveshaft housing of said outboard motor to a position within a preselected distance of said transom.

4. The support system of claim 1, further comprising:

a plurality of rod-shaped fasteners, each of said plurality of rod-shaped fasteners extending through a preselected hole through said intermediate member and into an associated one of said plurality of mounts.

5. The support system of claim 1, wherein:

a first one of said plurality of mounts is attached to a driveshaft housing of said outboard motor and a second one of said plurality of mounts is attached to an adapter plate of said outboard motor.

6. The support system of claim 1, wherein:

said outboard motor and said intermediate member being attached to each other for synchronous rotation about said tilt axis.

7. A support system for an outboard motor, comprising:

a transom mount structure which is attachable to a transom of a marine vessel, said marine vessel having a generally vertical plane of symmetry which divides said marine vessel into port and starboard portions, said transom mount structure being configured to define a generally vertical steering axis which is fixed in relation to said transom of said marine vessel, said transom mount structure being configured to define a generally horizontal tilt axis which is generally perpendicular to said plane of symmetry and fixed in relation to said transom of said marine vessel;

an outboard motor having a plurality of mounts attached thereto, each of said plurality of mounts having a central axis which is generally horizontal and parallel to said plane of symmetry; and an intermediate member attached to said transom mount structure for rotation about said tilt axis relative to said transom, in synchrony with said outboard motor, and for rotation about said steering axis relative to said transom, said intermediate member being attached to said plurality of mounts of said outboard motor.

8. The support system of claim 7, further comprising:

a hydraulic cylinder attached between said transom mount structure and said outboard motor, said hydraulic cylinder being configured to exert a force which causes said outboard motor to rotate about said tilt axis.

9. The support system of claim 8, further comprising:

first and second protrusions extending from said intermediate member in a direction toward said transom mount structure on port and starboard sides, respectively, of a portion of said transom mount structure when said intermediate member is rotated about said tilt axis to move a driveshaft housing of said outboard motor to a position within a preselected distance of said transom.

10. The support system of claim 9, further comprising:

a plurality of rod-shaped fasteners, each of said plurality of rod-shaped fasteners extending through a preselected hole through said intermediate member and into an associated one of said plurality of mounts.

11. The support system of claim 9, wherein:

a first one of said plurality of mounts is attached to a driveshaft housing of said outboard motor and a second one of said plurality of mounts is attached to an adapter plate of said outboard motor.

12. A support system for an outboard motor, comprising:

a transom mount structure which is attachable to a transom of a marine vessel, said marine vessel having a generally vertical plane of symmetry which divides said marine vessel into port and starboard portions, said transom being generally perpendicular to said plane of symmetry of said marine vessel, said transom mount structure being configured to define a generally vertical steering axis which is generally parallel to said plane of symmetry and fixed in relation to said transom of said marine vessel, said transom mount structure being configured to define a generally horizontal tilt axis which is generally perpendicular to said plane of symmetry and fixed in relation to said transom of said marine vessel;

an outboard motor having a plurality of mounts attached thereto, each of said plurality of mounts having a central axis which is generally parallel to said plane of symmetry;

an intermediate member which is attachable to said transom mount structure for rotation about said tilt axis relative to said transom and for rotation about said steering axis relative to said transom, said intermediate member being attachable to said plurality of mounts of said outboard motor, said outboard motor and said intermediate member being attached to each other for synchronous rotation about said tilt axis; and first and second protrusions extending from said intermediate member in a direction toward said transom mount structure on port and starboard sides, respectively, of a portion of said transom mount structure when said intermediate member is rotated about said tilt axis to move a driveshaft housing of said outboard motor to a position within a preselected distance of said transom.

13. The support system of claim 12, further comprising:

a hydraulic cylinder attached between said transom mount structure and said outboard motor, said hydraulic cylinder being configured to exert a force which causes said outboard motor to rotate about said tilt axis.

14. The support system of claim 13, further comprising:

a plurality of rod-shaped fasteners, each of said plurality of rod-shaped fasteners extending through a preselected hole through said intermediate member and into an associated one of said plurality of mounts.

15. The support system of claim 14, wherein:

a first one of said plurality of mounts is attached to a driveshaft housing of said outboard motor and a second one of said plurality of mounts is attached to an adapter plate of said outboard motor.

* * * * *